United States Patent [19]

Simper

[11] Patent Number: 4,961,664

[45] Date of Patent: Oct. 9, 1990

[54] NAIL POLISH CONTAINER HAVING A MOVEABLE BRUSH

[76] Inventor: Joyce Simper, 4733 Durango Dr., Buena Park, Calif. 90621

[21] Appl. No.: 379,216

[22] Filed: Jul. 13, 1989

[51] Int. Cl.[5] ..... A46B 11/00

[52] U.S. Cl. ..... 401/127; 401/112

[58] Field of Search ..... 401/127, 129, 126, 112, 401/102, 103, 109, 128, 130

[56] References Cited

U.S. PATENT DOCUMENTS

| | | | |
|---|---|---|---|
| 68,163 | 8/1867 | Burnet | 401/129 |
| 362,857 | 5/1887 | Rodden | 401/127 |
| 558,245 | 4/1896 | Williams | 401/127 |
| 580,013 | 4/1897 | Smith | 401/127 |
| 1,092,428 | 4/1914 | Browning | 401/127 |
| 1,117,863 | 11/1914 | Larson | 401/127 |
| 2,138,319 | 11/1938 | Bilbrey | 401/127 |
| 2,461,893 | 2/1949 | Gragliano | 401/127 |
| 4,525,090 | 6/1985 | Riley et al. | 401/127 |

FOREIGN PATENT DOCUMENTS

| | | | |
|---|---|---|---|
| 253971 | 4/1948 | Switzerland | 401/112 |
| 442641 | 1/1968 | Switzerland | 401/127 |
| 194482 | 3/1923 | United Kingdom | 401/127 |

*Primary Examiner*—Danton D. DeMille

*Attorney, Agent, or Firm*—T. M. Gernstein

[57] ABSTRACT

A special container for storing and dispensing nail polish includes a brush applicator unit that is movably mounted on the cap unit of the container. The brush unit is moved by depressing a button on the cap, and a stop means is included in one embodiment to hold the brush in the retracted and in the extended positions.

1 Claim, 2 Drawing Sheets

NAIL POLISH CONTAINER HAVING A MOVEABLE BRUSH

TECHNICAL FIELD OF THE INVENTION

The present invention relates to the general art of special containers, and to the particular field of nail polish containers.

BACKGROUND OF THE INVENTION

Nail polish is generally bottled in very small quantities and is often sold at very high prices. Often, a particular type of nail polish is discontinued, and if such nail polish is favored by a particular user, this user may be quite disappointed if a replacement is hard to obtain.

Because of this, many consumers seek to make full use of each container after it is purchased. This full use includes using it all, and for as long as possible.

Most nail polish is sold in containers having a brush applicator mounted in a cap that is threadably attachable to a body in which the nail polish is stored. The brush applicator includes a bristle section that is inserted into the nail polish and used to apply that nail polish. In order to keep the bristles of the applicator straight and neat, the brush applicator is generally mounted on the cap so that the bristles do not contact the bottom of the container when the cap is mounted on the body, even when the cap is fully threaded onto that body.

Because of such mounting, there may be a space or gap defined between the bottom of the body and the bristle section of the brush applicator. Any polish located in this space or gap may be difficult to reach with the brush applicator, especially if the user has wet nails and finds it difficult to manipulate the body to locate the polish in position to be reached by the bristle section. The polish thus may be wasted. If not wasted, the difficulty of reaching this last bit of polish may inhibit the use of such nail polish containers.

While there are nail polish applicators which are intended to make the application of polish easier, see, e.g., U.S. Pat. No. 2,673,362, the present inventor is not aware of any bottle-type nail polish container which permits easy access to any nail polish located on the very bottom of the container, yet will still maintain the bristle portion of the brush applicator in a straight and neat condition.

Therefore, there is a need for a bottle-type nail polish container which permits easy access to any nail polish located on the very bottom of the container, yet will still maintain the bristle portion of the brush applicator in a straight and neat condition.

OBJECTS OF THE INVENTION

It is a main object of the invention to provide a bottle-type nail polish container which permits easy access to any nail polish located on the very bottom of the container, yet will still maintain the bristle portion of the brush applicator in a straight and neat condition.

It is another object of the invention to provide a bottle-type nail polish container which permits easy access to any nail polish located on the very bottom of the container, yet will still maintain the bristle portion of the brush applicator in a straight and neat condition which is easily operated.

SUMMARy OF THE INVENTION

These, and other, objects are achieved by a nail polish container which includes a brush unit that is movably mounted on the cap of the container. The brush unit is normally in a retracted position which spaces a bristle portion thereof from the bottom of the container and thereby maintains that bristle portion neat and straight, but is movable into ah extended position to contact the bristle portion against the bottom of the container. A stop means is also included on one embodiment of the invention so the brush unit can be held in the extended position.

In this manner, the bristles of the brush applicator will not be damaged during normal use, but will be easily movable into contact with the last bit of polish in the container. This will permit a user to obtain full use of a bottle of nail polish.

DETAILED DESCRIPTION OF THE PREFERRED EMBODIMENT OF THE INVENTION

Figure 1:
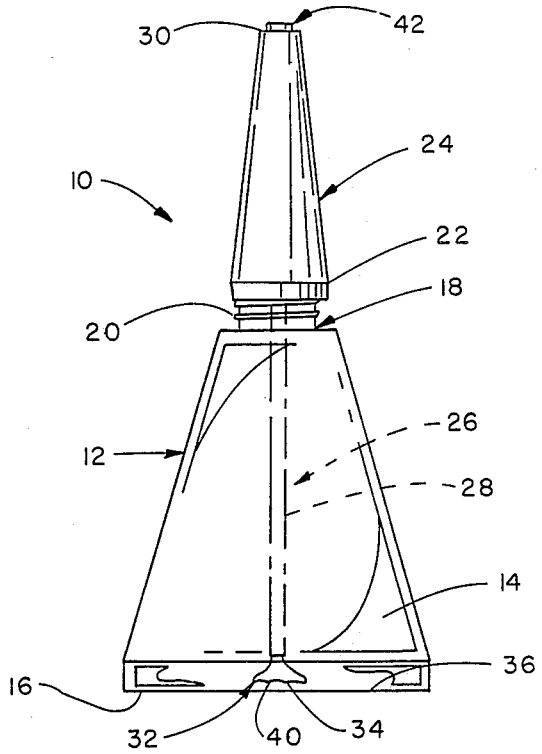
FIG. 1 is an elevational view of a nail polish container embodying the present invention.

Shown in FIG. 1 is a nail polish container 10 which includes a body portion 12 in which the polish is generally stored, and which has a wall 14, a bottom 16 and a neck portion 18. External threads 20 are located on the neck portion and cooperate with internal threads on a neck engaging portion 22 of a cap unit 24 to threadably hold that cap unit on the body 12.

Figure 2:
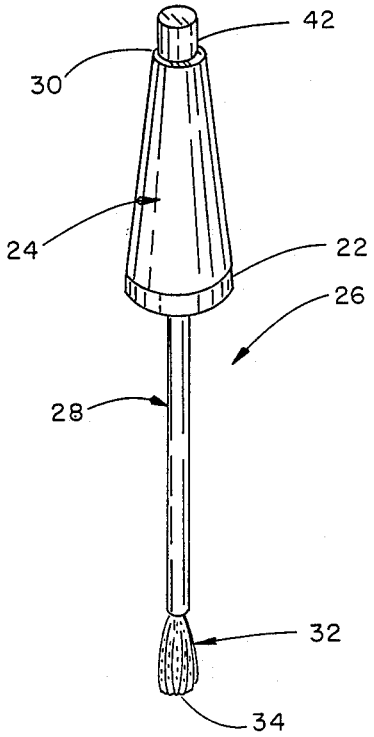
FIG. 2 is a perspective view of a brush applicator used in the nail polish container of the present invention.

A brush applicator unit 26 is shown in FIGS. 1 and 2, and includes a stem 28 dependingly attached at one end thereof to the cap unit at a top 30 of that cap unit, and which has a bristle unit 32 mounted on the other end of the stem.

In normal use of the container 10, nail polish is stored in the body 12, and the body is generally closed by the cap unit. Polish is applied by dipping the bristle unit into the nail polish contained in the body, and applying such polish to the selected surface. The normal configuration of the container has the bristle unit positioned so that the very bottom of that bristle unit indicated at 34 in FIG. 1, is spaced from the bottom surface 36 of the container bottom whereby the bristles of the unit will remain straight and neat so the polish can be neatly applied.

As can be seen in FIG. 1, the brush applicator unit is sized so that the bristle bottom 34 is spaced from the bottom container surface 36 When the cap 24 is fully threaded onto the body.

However, as can also be seen in FIG. 1, this sizing and positioning of the brush applicator unit with respect to the body defines a space or gap 40 between the bristle bottom 34 and the container bottom 36. Any nail polish located in this gap 40 will be extremely difficult to reach with the bristle unit, and may be wasted.

Accordingly, the container of the present invention includes a means for moving the bristle unit downwardly toward the bottom from the position shown for that unit in FIG. 1 so the bristle bottom 34 can contact the container bottom 36 and thereby eliminate the gap 40. In this manner, any nail polish located in the gap 40 will be accessible to the bristle unit, and hence will not be wasted.

Figure 3:
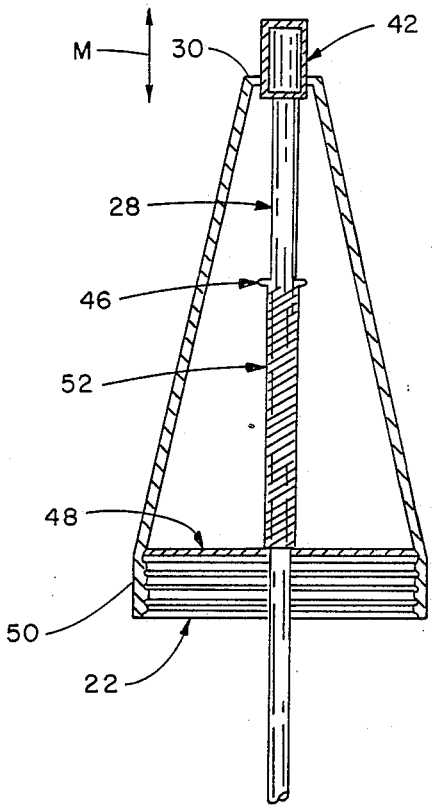
FIG. 3 is a cutaway elevational view of the nail polish container shown in FIG. 1.

As is best shown in FIGS. 2 and 3, the means to move the applicator brush towards the container bottom includes a button 42 mounted on the cap top 30 to move toward and away from the container bottom when the cap is mounted on the container body as indicated in FIG. 3 by the double-headed arrow 44. The stem 28 is dependingly attached to the button to move with that button. The stem also includes a spring seat 46, and a second spring seat 48 is mounted on the cap near internal threads 50 in the portion 22 of that cap unit.

A spring 52 is located between the two spring seats and is compressed to bias the button outwardly away from the container bottom 36 when the cap is on the container body.

In order to move the bristle unit 32 into contact with the container bottom 36, the button 42 is depressed towards that container bottom against the force of the spring 42 until the bristle unit closes the gap 40 sufficiently to become immersed in the nail polish located in that gap.

In the first embodiment of the container, there is no stop means for maintaining the brush in an extended position, that is a position with the button depressed and forcing the bristle unit towards the container bottom. Thus, releasing the button will permit the spring 52 to move the stem outwards away from the container bottom back into the normal position of the applicator unit with a gap 40 defined between the bristle unit and the container bottom.

Figure 4:
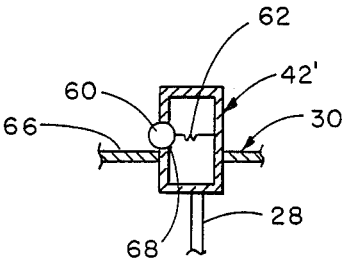
FIGS. 4–6 are schematic representations of a button on the brush applicator which functions as a stop means to hold the brush applicator in either a retracted or an extended position as that applicator moves from the retracted position to the neutral position to the extended position.
Figure 5:
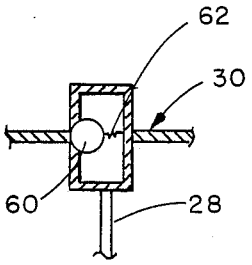
Figure 6:
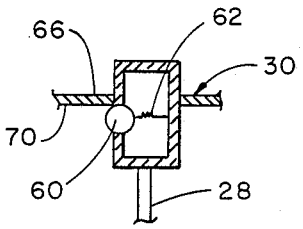

In some cases, the user may not want to continually force the bristle unit into the extended position contacting the container bottom. Accordingly, the invention includes a second embodiment in which a stop means is included to hold the brush applicator unit in an extended position closing the gap 40. This stop means is best indicated in FIGS. 4–6, and includes a ball 60 movably mounted on hollow button 42' to move out of that button and into that button. A spring 62 mounts the ball 60 to the interior of the button 42' and biases that ball outwardly of the button towards the FIG. 4 position.

In the FIG. 4 position, the applicator unit is in the retracted position with the bristle unit spaced from the container bottom, and the ball 60 engages outer surface 66 of the top 30.

The brush applicator unit is moved towards the extended position in which the bristle unit contacts the container bottom by depressing the button 42' toward the container bottom. This action is resisted by the frictional contact between the ball 60 and the surface 66 and the biasing force associated with the spring 62. However, these resisting forces are established so that slight pressure on the button 42' can overcome such forces and move the applicator unit toward the container bottom. The button moves into a neutral position shown in FIG. 5 as the unit moves toward the extended position. In the neutral position, the ball is forced into the interior of the button 42' against the bias of the spring 62 and contacts the edge 68 of the wall 30.

Further inward pressure on the button 42' moves the button and the applicator unit farther toward the container bottom until the applicator is in the fully extended position with the bristle unit in contact with the container bottom. The fully extended position is shown in FIG. 6, and the ball 60 is forced out of the button as soon as it clears lower surface 70 of the wall 30. In this position, the ball 60 resists upward force on the applicator unit which upward force tends to move that unit back to the retracted position shoWn in Figure 4. Such upward force results from the spring 52 discussed above.

The applicator unit is moved back to the FIG. 4 retracted position from the FIG. 6 extended position by grasping the button 42' and pulling it upwardly toward the FIG. 4 position. The force necessary to move the ball 60 inwardly so the button can assume the neutral position shown in FIG. 5 from the FIG. 6 extended position is less than the force necessary to move the ball into the FIG. 5 neutral position from the FIG. 4 retracted position since the spring 52 adds its force to assist the retraction movement from the FIG. 6 extended position, and adds it force to resist the movement from the FIG. 4 extended position. Thus, even if the user has wet nails, the retraction movement of the button 42' is easily accomplished.

It is understood that while certain forms of the present invention have been illustrated and described herein, it is not to be limited to the specific forms or arrangements of parts described and shown.

I claim:

1. A container for nail polish comprising:

(A) a body for containing nail polish therein and having a neck portion with external threads on one end and a bottom on another portion; and (B) a hollow cap unit for closing the body and which includes (1) a cylindrical neck engaging portion on one end of said cap unit, said neck engaging portion having internal threads which co-operate with said body external threads, (2) a frusto-conical side wall extending from said neck engaging portion with said neck engaging portion being located at a base section of said frusto-conical side wall, (3) a circular top wall on said side wall on another end of said cap unit, said circular top wall having a diameter which is smaller than the cylindrical neck engaging portion, said side wall converging from said neck engaging portion to said top wall, said circular top wall having a top surface and a bottom surface and having a circular bore defined therethrough with said circular bore having a center which is located on the center of said circular top wall, (4) a circular base wall connected to said side wall adjacent to said base section, said base wall closing said cap unit base section, a combination of said side wall said top wall and said base wall cooperating to define an interior volume of said hollow cap unit, said top wall bottom surface being located inside said interior volume and said top wall top surface being located outside said interior volume, said cap unit circular base wall having a circular bore defined therethrough, said base wall circular bore having the center thereof located on the center of the base wall and in alignment with the center of said top wall circular bore center, (5) a hollow cylindrical button having a circular top end and a circular bottom end, with said button circular top and bottom ends having diameters which are equal to each other, said button further including a cylindrical side wall connecting said button top and bottom ends and which has an outer diameter which is essentially equal to the diameter of said top wall circular bore and which frictionally engages the top wall adjacent to said circular top wall bore and being slidably movable on said top wall to move towards and away from said body bottom when said cap unit is mounted on said body, said button having a length measured between said button top end and said button bottom end, (6) a brush applicator unit attached to said button and extending toward said body bottom when said cap unit is mounted on said body, said brush unit having (a) a stem attached at one end thereof to said button bottom end and extending through the bore defined through said base wall, (b) a bristle unit attached at another end of said stem to be located adjacent to said body bottom when said cap unit is mounted on said body, (c) a return spring mounted on said stem, (d) a spring seat on said stem, said spring seat being spaced from said button bottom end and located within said interior volume, (e) said return spring having one end thereof seated against said spring seat and another end thereof seated against said base wall adjacent to the bore defined through said base wall and biasing said stem away from said body bottom;

(C) a stop means on said cap unit which holds said button in a first position with said bristle unit spaced from said body bottom when said cap unit is mounted on said body and said button is in a retracted position, and which holds said bristle unit in a forward position in contact with said body bottom when said button is forced towards said base wall, said stop means including (1) a circular button hole defined through said cylindrical button side wall, said button hole being located approximately midway between said button top end and said button bottom end and being sized so that at least about one-fourth of the button length is located between said button hole and said button top end, (2) a spring having one end thereof engaged against said button side wall, said stop means spring being located inside said button adjacent to said button hole, (3) a spherical ball mounted on said stop means spring and being forced against said button side wall adjacent to said button hole, said spherical ball having an outer diameter which is greater than the diameter of said circular button hole and having a portion thereof extending outwards beyond said button side wall when forced against said button side wall by said stop means spring, said ball portion engaging said top wall top surface to hold said bristle unit in said retracted position and engaging said top wall bottom surface inside said interior volume to hold said bristle unit in said forward position, and (4) a grasping means on said button, said grasping means including the portion of said button located between said button hole and said button top end when said bristle unit is in said forward position, said grasping means being used to pull said button from said forward position to said retracted position.

* * * * *